US007859950B2

(12) United States Patent
Calabrese

(10) Patent No.: US 7,859,950 B2
(45) Date of Patent: Dec. 28, 2010

(54) LARGE DATE CALENDAR DAY MECHANISM FOR A TIMEPIECE

(75) Inventor: Vincent Calabrese, Lausanne (CH)

(73) Assignee: BlancPain S.A., Le Brassus (CH)

( * ) Notice: Subject to any disclaimer, the term of this patent is extended or adjusted under 35 U.S.C. 154(b) by 7 days.

(21) Appl. No.: 12/536,906

(22) Filed: Aug. 6, 2009

(65) Prior Publication Data

US 2010/0034055 A1 Feb. 11, 2010

(30) Foreign Application Priority Data

Aug. 11, 2008 (EP) ..... 08162165
Oct. 15, 2008 (EP) ..... 08166699

(51) Int. Cl.
*G04B 19/20* (2006.01)

(52) U.S. Cl. ..... 368/37; 368/233

(58) Field of Classification Search ..... 368/28–40, 368/232–233, 77, 221–223
See application file for complete search history.

(56) References Cited

U.S. PATENT DOCUMENTS

| | | | | |
|---|---|---|---|---|
| 2,976,672 | A * | 3/1961 | Ducommun | 368/37 |
| 3,518,825 | A * | 7/1970 | Nissen | 368/37 |
| 4,257,113 | A * | 3/1981 | Meister et al. | 368/35 |
| 5,327,401 | A * | 7/1994 | Besson et al. | 368/37 |
| 6,081,483 | A * | 6/2000 | Capt et al. | 368/28 |
| 6,925,032 | B2 * | 8/2005 | Willemin et al. | 368/28 |
| 6,934,221 | B2 * | 8/2005 | Willemin et al. | 368/28 |
| 7,023,762 | B1 * | 4/2006 | Burkhardt et al. | 368/35 |
| 7,532,546 | B2 * | 5/2009 | Suzuki et al. | 368/37 |
| 7,706,214 | B2 * | 4/2010 | Scheufele | 368/38 |
| 2002/0080687 | A1 * | 6/2002 | Rochat et al. | 368/37 |
| 2002/0159337 | A1 * | 10/2002 | Weissbach et al. | 368/37 |
| 2003/0103417 | A1 * | 6/2003 | Gabathuler et al. | 368/37 |
| 2005/0152225 | A1 * | 7/2005 | Dias | 368/77 |
| 2005/0174891 | A1 * | 8/2005 | Besse | 368/37 |
| 2008/0279049 | A1 * | 11/2008 | Schmiedchen et al. | 368/37 |
| 2009/0303841 | A1 * | 12/2009 | Noguchi | 368/37 |

FOREIGN PATENT DOCUMENTS

| | | | |
|---|---|---|---|
| CH | 125 522 | A | 4/1928 |
| CH | 660 941 | A3 | 6/1987 |
| DE | 195 39 087 | A1 | 7/1997 |

OTHER PUBLICATIONS

Partial Translation of CH 125522: Source epo.worldlingo.com; Sep. 16, 2010.*

* cited by examiner

*Primary Examiner*—Renee Iuebke
*Assistant Examiner*—Sean Kayes
(74) *Attorney, Agent, or Firm*—Sughrue Mion, PLLC

(57) ABSTRACT

The large date mechanism comprises three superposed indicator discs (1, 2, 3). The lower disc (3) bears eleven numerals (8) and the upper (1) and intermediate (2) discs each bear ten numerals (4, 6) and a window (5, 7). Each of the discs is integral to a star wheel (12, 13, 14) with cannon pinions (9, 10, 11). The cannon pinion star wheels are selectively driven by a control movement (15) comprising three toothed sectors (19, 18, 17) integral to a calendar day wheel (16) that advances one step per day. The mechanism can be supplemented by a safety device ensuring blocking of the star wheels when they should be stationary.

6 Claims, 9 Drawing Sheets

LARGE DATE CALENDAR DAY MECHANISM FOR A TIMEPIECE

The present invention relates to a large date calendar day mechanism for a timepiece comprising indicators superposed one on top of the other, to which a portion of the numerals of the days of the month is affixed, said numerals appearing in turn through a large aperture drilled into the dial forming part of the timepiece.

Such mechanisms have already been proposed, for example, in patent document CH 660 941. Two display rings superposed one on top of the other, each having a portion of the numerals of the calendar day, are provided in this document. The upper ring has a window through which the numerals of the lower ring can be seen if this window is at the location of the display provided by an aperture drilled into the dial of the timepiece. The system provides selective drive means to drive one of the rings while the other remains stationary. Additional drive means ensure that the ring is moved to a stationary state for an extended time as the other ring runs through all its numerals. Then, the other ring is caused to be stationary for an extended time until the drive means in abutment cause the two rings to advance.

The present invention proposes another advantageous solution for providing a display of the calendar day through a large aperture. This new solution requires an assembly of very simple components and allows a large-dimension display, the day numerals being distributed over three indicators instead of only two.

Hence, in addition to complying with the statements in the first paragraph of this description, the embodiment according to the invention is distinguished in that the indicators comprise an upper disc, an intermediate disc and a lower disc, wherein the upper disc is divided into eleven sectors, of which ten are occupied by numerals from 1 to 10 and one is occupied by a window, through which the numerals of the intermediate disc can be seen, the intermediate disc is divided into eleven sectors, of which ten are occupied by numerals from 11 to 20 and one is occupied by a window, through which the numerals of the lower disc can be seen, and the lower disc is divided into eleven sectors, all of which are occupied by numerals from 21 to 31, in that each of the discs is driven by a cannon pinion integral to a star wheel, wherein these cannon pinions are freely pressed one into the other, and in that a control movement fitted with a calendar day wheel advancing one step per day is arranged to selectively mesh with the star wheels provided for the discs in order to drive the upper disc while the other two discs remain stationary, to drive the intermediate disc when the upper disc has run through all its numerals, while the upper and lower discs remain stationary, and to drive the lower disc when the intermediate disc has run through all its numerals, while the upper and intermediate discs remain stationary.

The invention shall now be explained in detail below by means of drawings illustrating two embodiments given as non-restrictive examples, wherein.

Figure 6A:
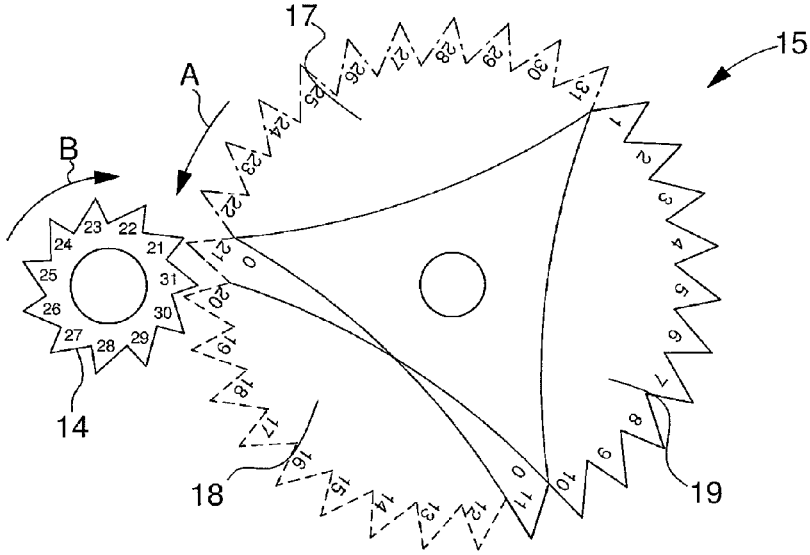
Figure 6B:
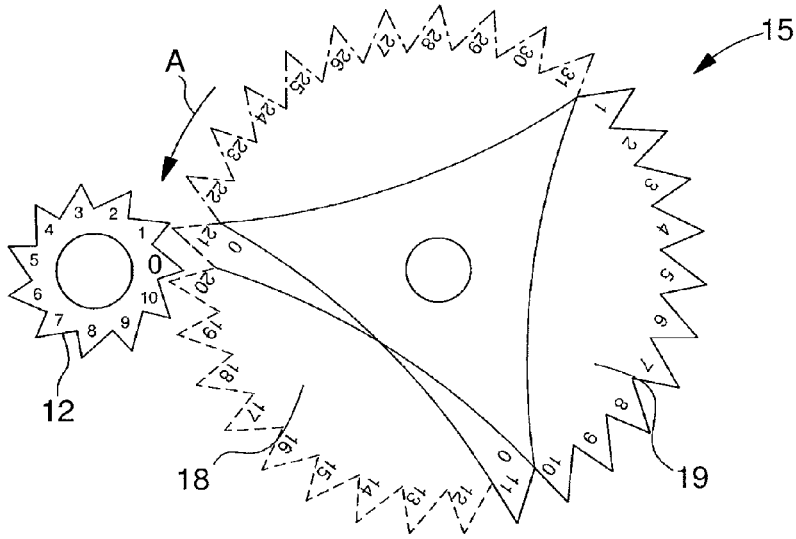
Figure 6C:
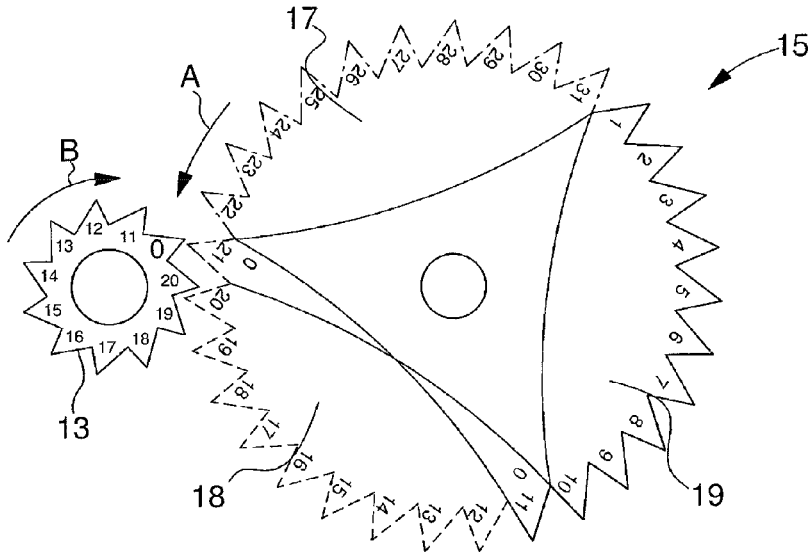
Figure 7A:
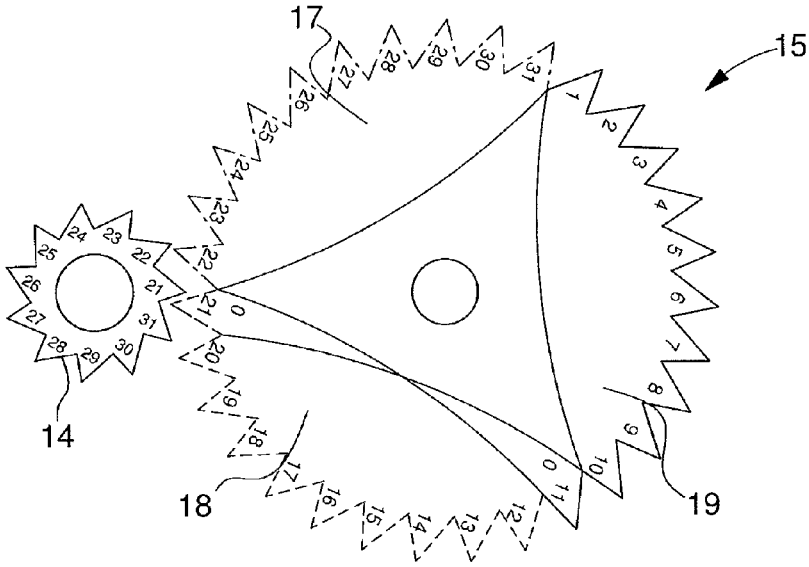
Figure 7B:
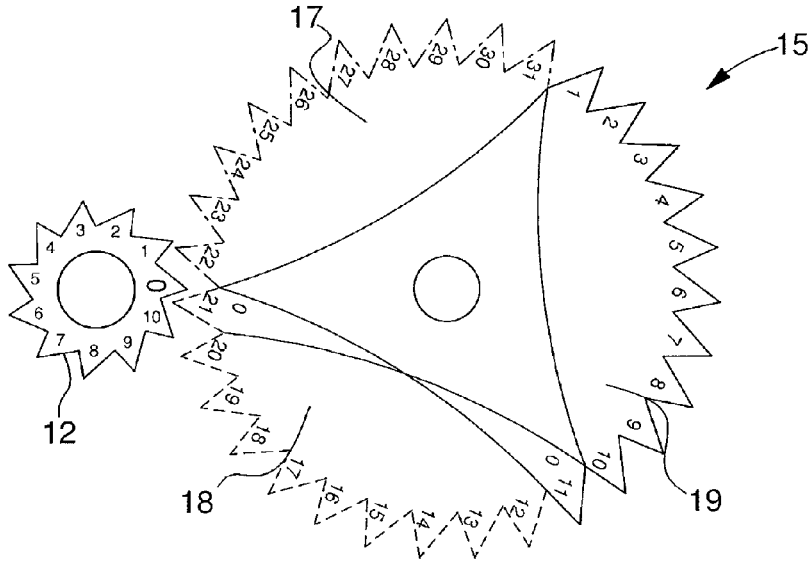
Figure 7C:
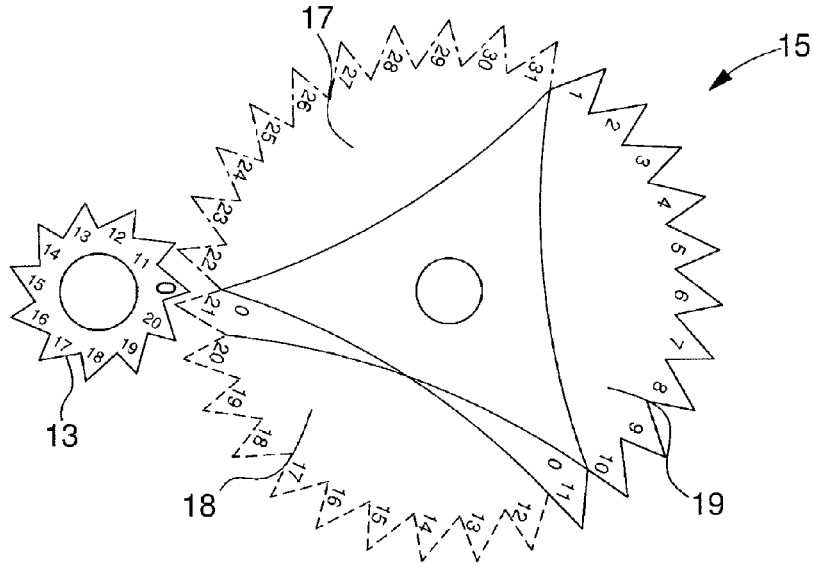
Figure 8:
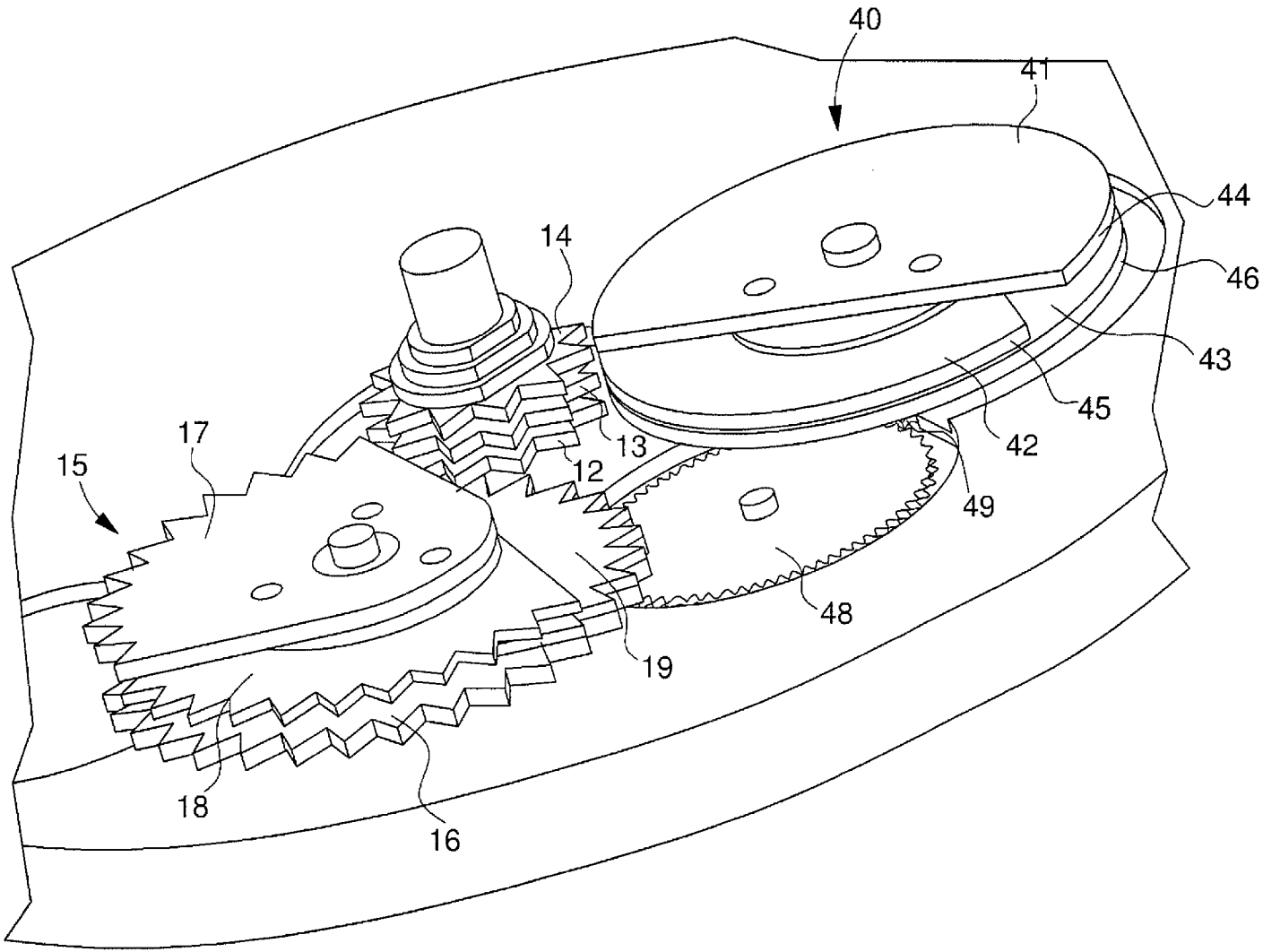
Figure 9A:
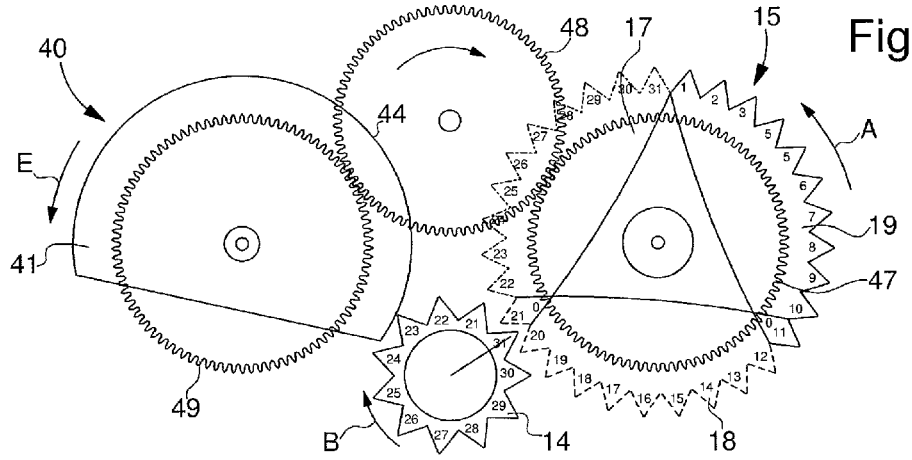
Figure 9B:
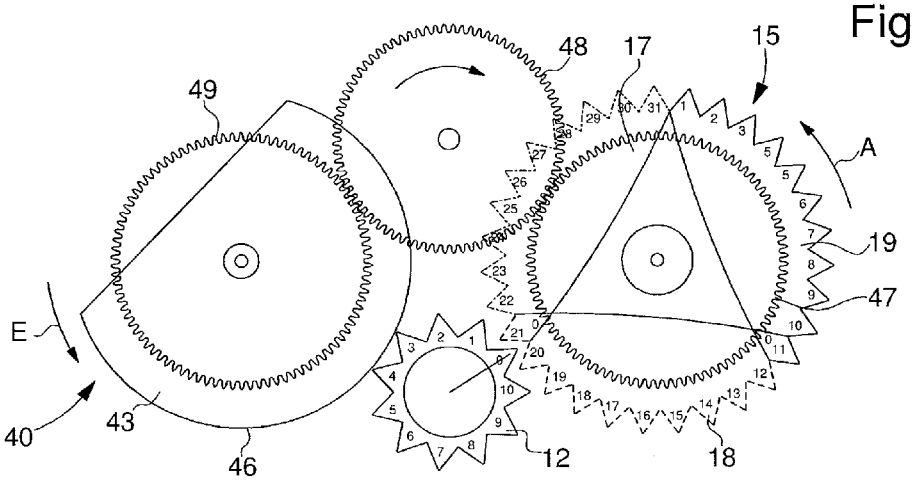
Figure 9C:
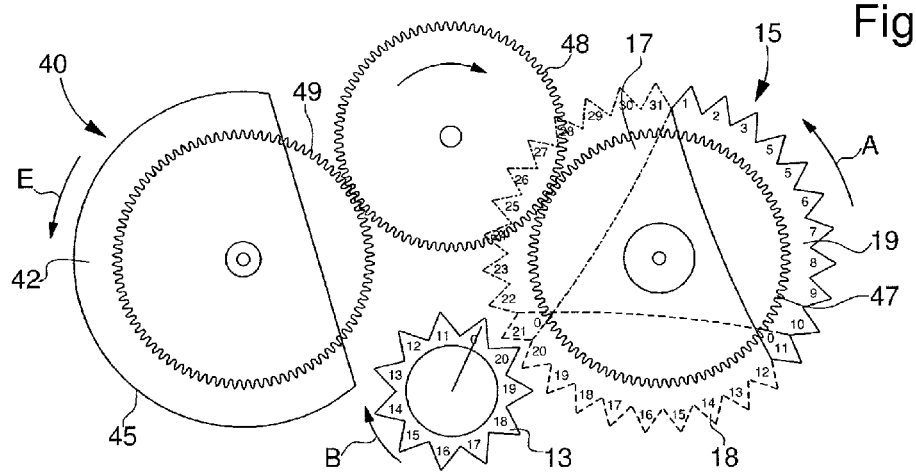
Figure 10A:
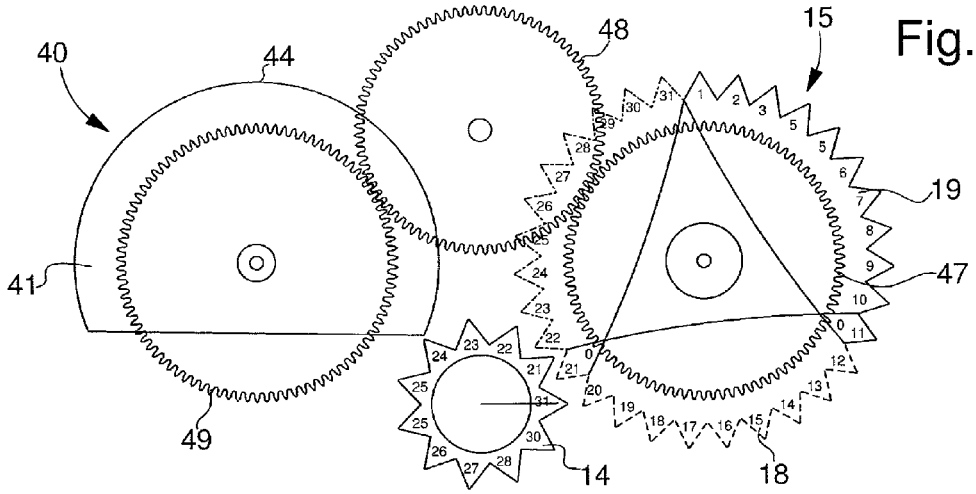
Figure 10B:
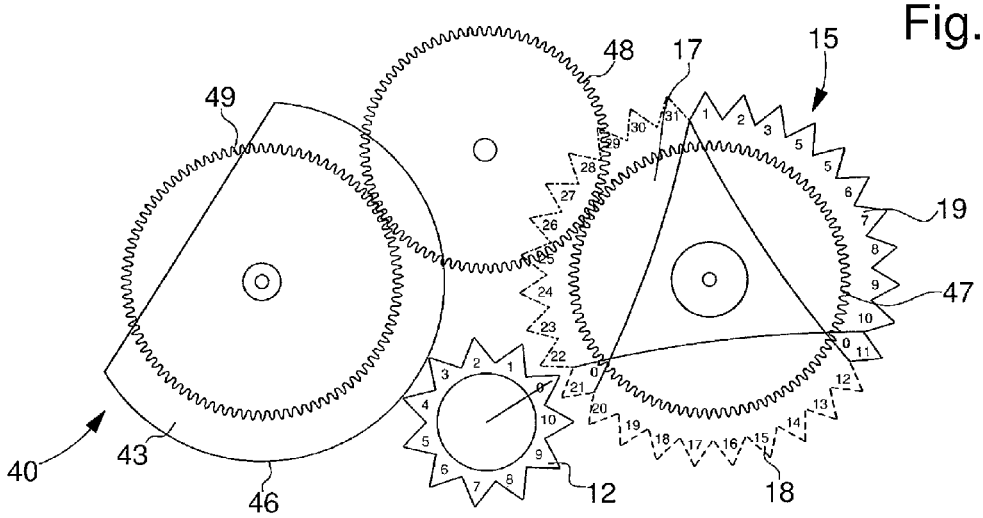
Figure 10C:
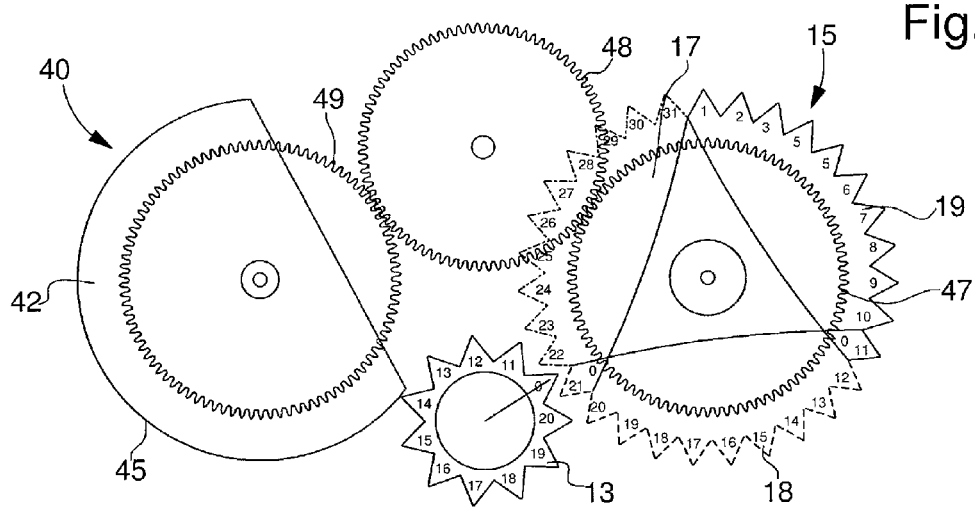

FIGS. 6*a*, 6*b* and 6*c* show the positioning of the control movement and the cannon pinion star wheels supporting the display discs on the 20th of the month;

FIGS. 7*a*, 7*b* and 7*c* show the positioning of the control movement and the cannon pinion star wheels supporting the display discs on the 21st of the month;

FIG. 8 is a perspective view of the calendar day mechanism according to the second embodiment of the present invention, in which a safety device has been added to the base mechanism;

FIGS. 9*a*, 9*b* and 9*c* show the positioning of the control movement, the cannon pinion star wheels supporting the display discs and the safety device on the 20th of the month; and FIGS. 10*a*, 10*b* and 10*c* show the positioning of the control movement, the cannon pinion star wheels supporting the display discs and the safety device on the 21st of the month.

Figure 1:
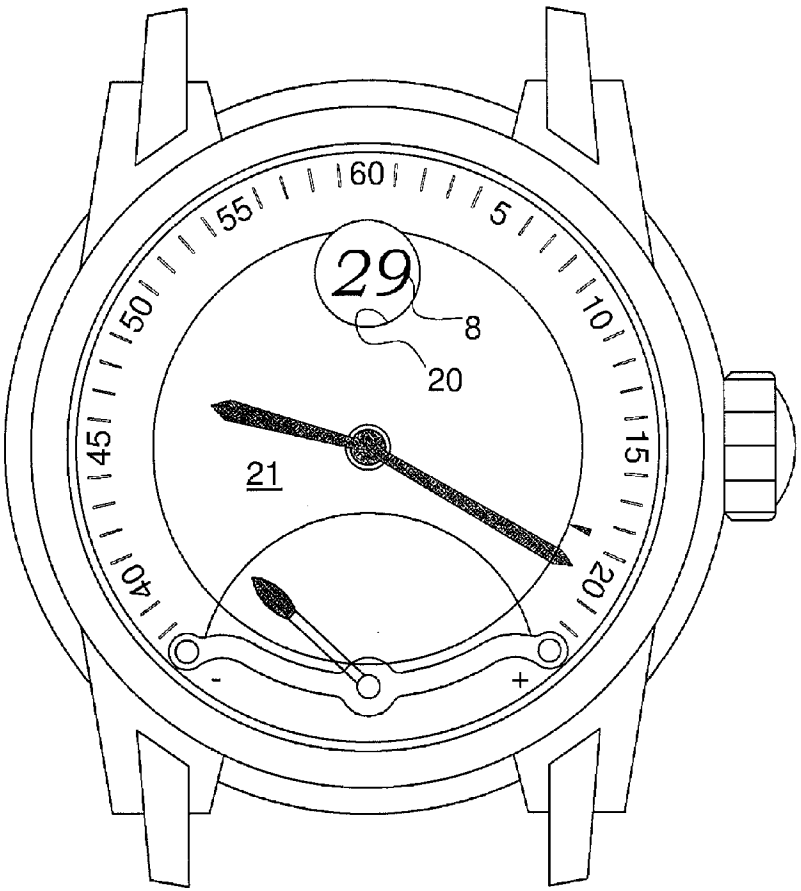
FIG. 1 is a plan view onto a timepiece in which the calendar day mechanism of the present invention is installed.

FIG. 1 is a view of a timepiece in which day 8 is shown in large dimensions at midday through a large aperture 20 drilled into a dial 21. The calendar day mechanism to which this description relates is installed under the dial 21.

Figure 2:
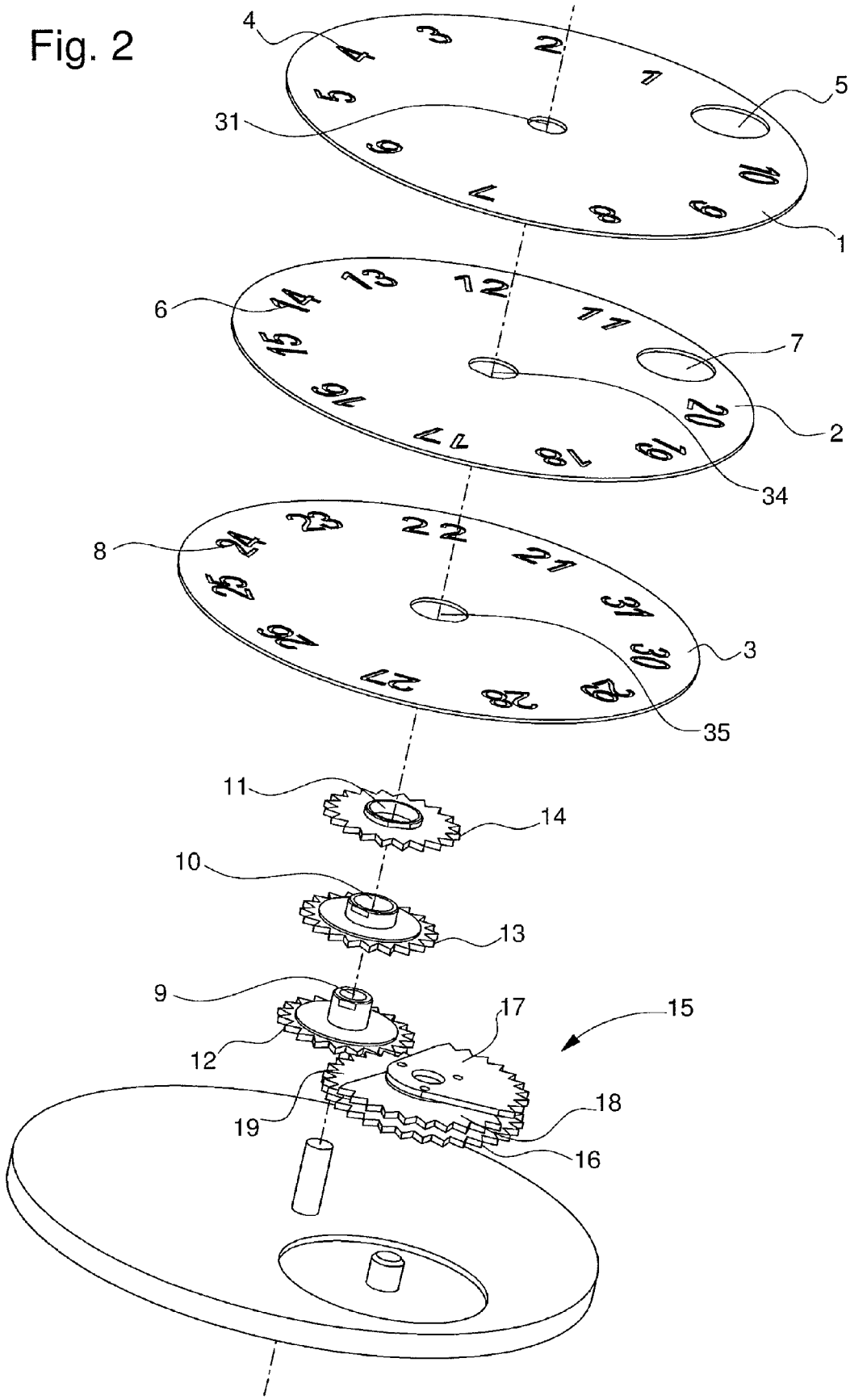
FIG. 2 is an exploded perspective view of the calendar day mechanism according to the first embodiment of the present invention.

FIG. 2 is an exploded perspective view of the calendar day mechanism according to a first embodiment of the present invention. This large date calendar day mechanism comprises indicators superposed one on top of the other, to which a portion of the numerals of the days of the month is affixed to together show all thirty one days of the month. These numerals appear in turn through a large aperture 20 drilled into a dial 21, as shown in FIG. 1.

The invention is distinguished in that the indicators comprise an upper disc 1, an intermediate disc 2 and a lower disc 3. As is clearly visible in FIG. 2, the upper disc 1 is divided into eleven sectors, of which ten are occupied by numerals 4 from 1 to 10 and one is occupied by a window 5, through which the numerals 6 of the intermediate disc 2 can be seen. The intermediate disc 2 is also divided into eleven sectors, of which ten are occupied by numerals 6 from 11 to 20 and one is occupied by a window 7, through which the numerals 8 of the lower disc 3 can be seen. Finally, the lower disc 3 is likewise divided into eleven sectors, all of which are occupied by numerals 8 from 21 to 31.

FIG. 2 also shows that each of the discs 1, 2 and 3 is driven by a cannon pinion given the reference 9, 10 and 11 respectively. Each cannon pinion 9, 10 and 11 is integral to a star wheel given the reference 12, 13 and 14. As is shown more clearly in FIGS. 3 and 4, the cannon pinions 9, 10 and 11 are pressed freely one into the other.

It is noted here that the entrainment of disc 1 by the cannon pinion 9 is achieved by means of cuts 30 arranged on either side of the cannon pinion 9, wherein these cuts 30 receive faces worked into a drill hole 31 located at the centre of the disc 1. The same applies for cannon pinions 10 and 11 that are respectively provided with cuts 32 and 33 adapted to faces worked into the central drill holes 34 and 35 of discs 2 and 3.

FIG. 2 shows that a control movement 15 to be described in more detail below is arranged to selectively mesh with the star wheels 12, 13 and 14 provided for discs 1, 2 and 3. This gearing is performed to drive the upper disc 1 while the other two discs 2 and 3 remain stationary, then to drive the intermediate disc 2 when the upper disc 1 has run through all its numerals 4, while the upper 1 and lower 3 discs remain stationary, and then to drive the lower disc 3 when the intermediate disc 2 has run through all its numerals, while the upper 1 and intermediate 2 discs remain stationary.

It can be seen that the control movement 15 is fitted with a calendar day wheel 16 that advances one step per day, bears thirty one teeth and is controlled by a mechanism, which is known per se and is not shown in the drawing.

Figure 3:
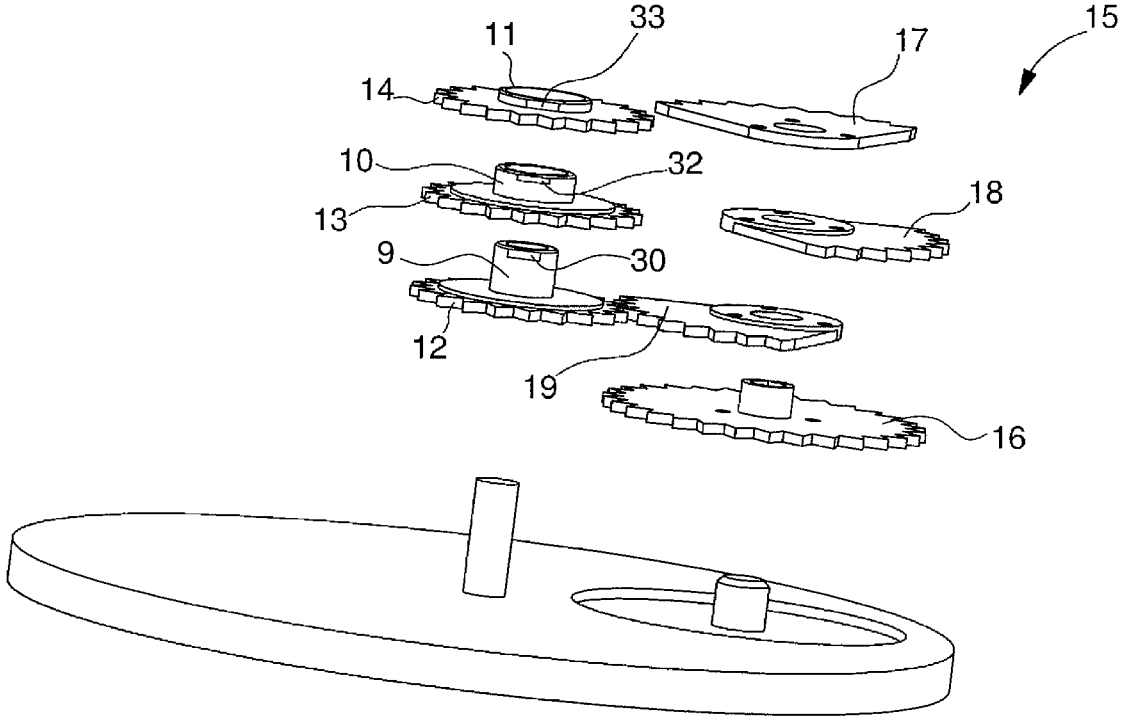
FIG. 3 is an exploded perspective view of a part of the mechanism shown in FIG. 2.
Figure 4:
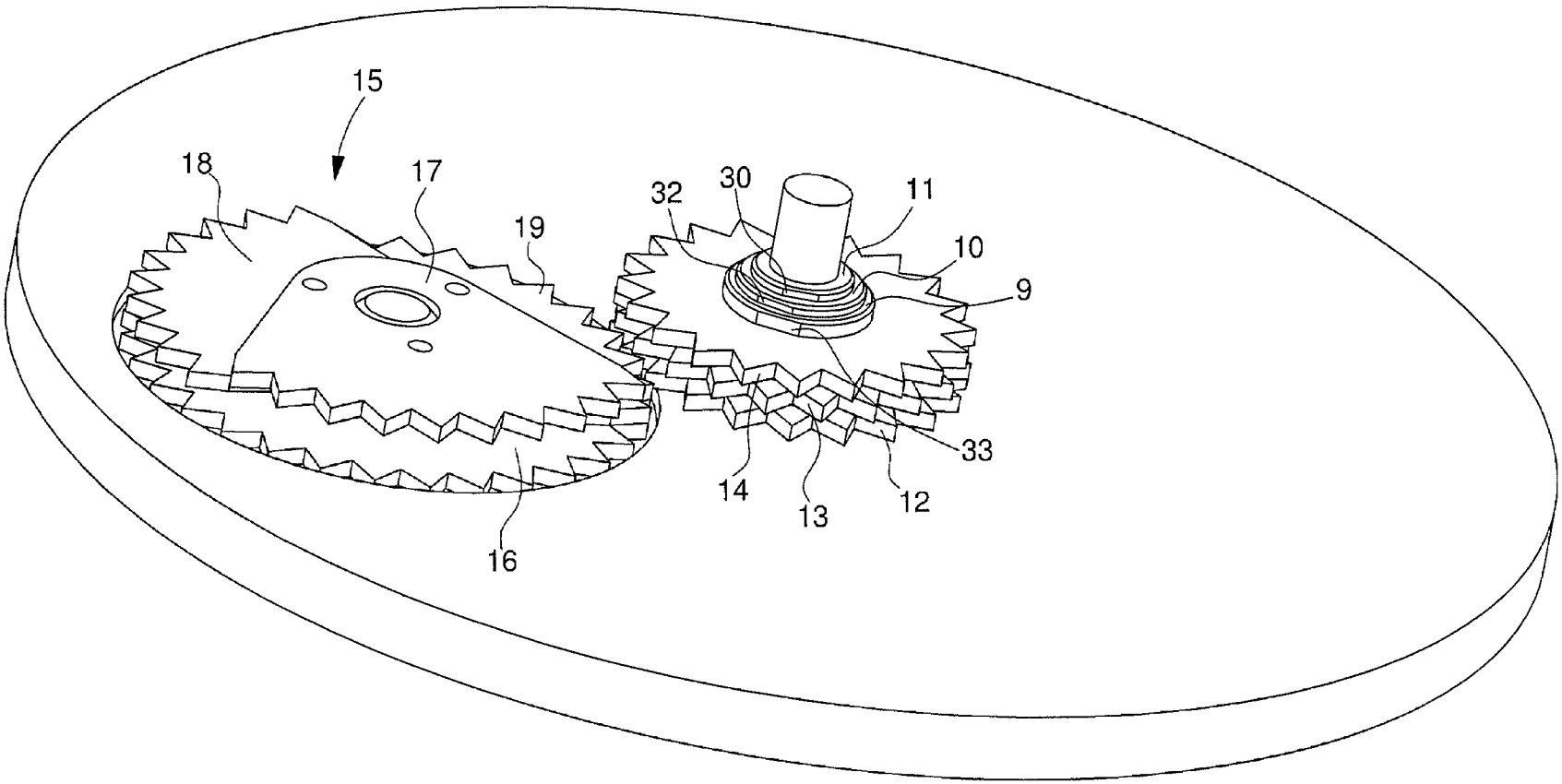
FIG. 4 is a perspective view showing the meshing of the control movement with the cannon pinion star wheels supporting the display discs according to the invention.

As may be seen particularly clearly in FIGS. 2, 3 and 4, the control movement 15 comprises upper 17, intermediate 18 and lower 19 toothed sectors, which are fixed coaxially on the calendar day wheel 16, arranged coaxially on one another and angularly offset in relation to one another. These toothed sectors are arranged to selectively mesh with the star wheels 14, 13 and 12 provided for the lower 3, intermediate 2 and upper 1 discs.

More precisely, the upper 17, intermediate 18 and lower 19 toothed sectors each comprise eleven teeth, the teeth of the lower sector 19 being numbered from 1 to 11, those of the intermediate sector 18 from 11 to 21 and those of the upper sector 17 from 21 to 31. This highlights the significance of such a construction that proposes identically produced pieces, i.e. three toothed sectors of the same fabrication.

Figure 5:
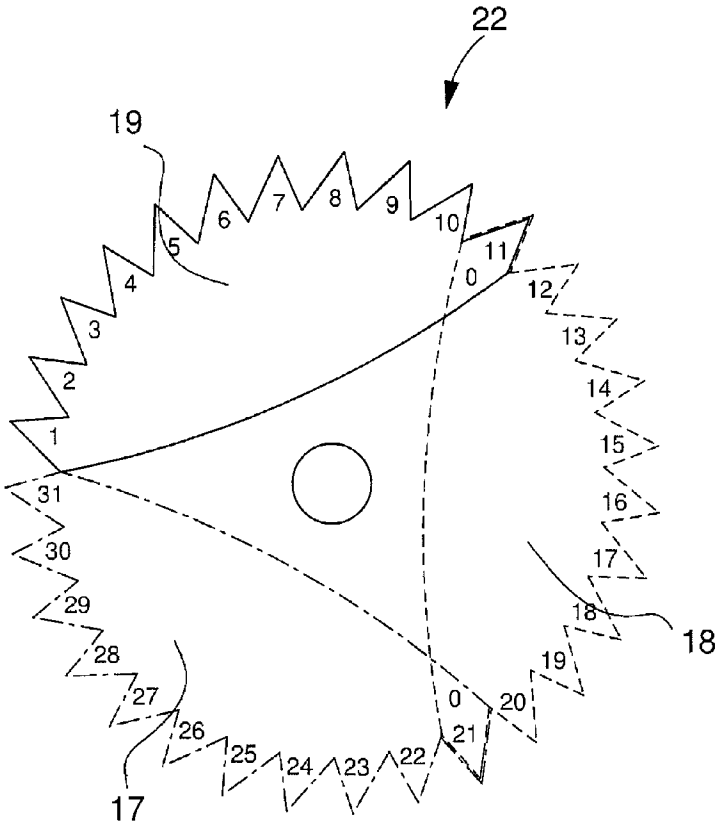
FIG. 5 is a vertical projection of the three toothed sectors of the control movement.

The three toothed sectors are shown in plan view and in vertical projection in FIG. 5. This consists of a wheel 22 that has three levels. Tooth 11 of the lower sector 19 overlaps tooth 11 of the intermediate sector 18, so that the window 5 of the upper disc 1 and the calendar day numeral 11 positioned on the intermediate disc 2 appear in the large aperture 20. Further on, tooth 21 of the intermediate sector 18 overlaps tooth 21 of the upper sector 17, so that the window 7 of the intermediate disc 2 and the calendar day numeral 21 positioned on the lower disc 3 appear in the large aperture 20. This movement from day 20 to day 21 will be examined below with reference to FIGS. 6 and 7. Finally, tooth 31 of the upper sector 17 adjoins tooth 1 of the lower sector 19, so that the calendar day numeral 1 positioned on the upper disc 1 appears in the large aperture 20.

FIGS. 6*a*, 6*b* and 6*c* show the positioning of the control movement 15 and the cannon pinion star wheels 12, 13 and 14 on the 20th of the current month. In FIG. 6*a*, the lower disc 3 connected to the star wheel 14 has the numeral 31 aligned with the large aperture 20, numeral 31 is not visible because it is concealed by the intermediate disc 2. In FIG. 6*b*, the upper disc 1 connected to the star wheel 12 has its window 5 (symbolised by the number 0 in the figure) aligned with the large aperture 20. In FIG. 6*c*, the intermediate disc 2 connected to the star wheel 13 has the numeral 20 aligned with the large aperture 20 and this numeral 20 is visible through the window 5 of the upper disc 1.

At midnight on the 20th of the month, the control movement 15 advances one step in the direction indicated by arrow A, which causes star wheel 14 connected to the lower disc 3 and star wheel 13 connected to the intermediate disc 2 to advance one step in the direction of arrow B. The star wheel 12 connected to the upper disc 1 is not driven by the movement 15, as the toothed sector 19 capable of causing this drive movement is located diametrically opposed to the star wheel 12.

Thus, on the 21st of the current month FIGS. 7*a*, 7*b* and 7*c* show the positioning of the control movement 15 and the cannon pinion star wheels 12, 13 and 14. In FIG. 7*a*, the lower disc 3 connected to the star wheel 14 has the numeral 21 aligned with the large aperture 20. In FIG. 7*b*, the upper disc 1 connected to the star wheel 12, as previously, has its window 5 (symbolised by the number 0 in the figure) aligned with the large aperture 20. In FIG. 7*c*, the intermediate disc 2 connected to the star wheel 13 has its window 7 (symbolised by the number 0 in the figure) aligned with the large aperture 20. Thus, on the 21st of the month the date is displayed by the lower disc 3 visible through windows 5 and 7 on discs 1 and 2 respectively.

The large aperture 20 mentioned above is that drilled into the dial 21 of the timepiece shown in FIG. 1. In the schematic views of FIGS. 6 and 7, the large aperture 20 is located on a line connecting the centre of the control movement 15 and the centre of the star wheels 12, 13 and 14 and at the meshing point of the teeth of said movement and said star wheels.

Drawings 2, 3 and 4 show that the cannon pinions 9, 10 and 11, each provided with a star wheel 12, 13 and 14, are freely pressed one into the other. It is thus conceivable that a cannon pinion driven by the control movement may drive another cannon pinion that should remain stationary, i.e. by simple friction. Untimely entrainment of the cannon pinion star wheels as a result of impacts applied to the timepiece may also be of concern. Such anomalies would cause a maladjustment in the display of the calendar day that could only be corrected by a watchmaker who would have to disassemble the timepiece. To avoid this, each of the star wheels 12, 13 and 14 can be fitted with a catch consisting of a spring with two inclined faces at its ends that are supported between the points of two consecutive teeth of the star wheel to hold it in place. This simple solution is not shown in the figures because it is within the range of knowledge of a person skilled in the art. However, a disadvantage of the use of catches is the consumption of energy, thus reducing the time during which the timepiece is autonomous.

To avoid the use of catches indicated above, the present invention proposes a second embodiment comprising a system for blocking the cannon pinion star wheels that only requires very little energy while also providing more security than that generated by classic catches. This second embodiment will now be described with reference to FIGS. 8, 9 and 10.

FIG. 8 retains the calendar day mechanism described in detail above. The control movement 15 still cooperates selectively with the cannon pinion star wheels 12, 13 and 14 that respectively drive the day discs 1, 2 and 3 (not shown in the drawing). In this second embodiment, the control movement 15 drives a blocking movement 40, which is arranged to prevent any accidental advancing of the discs 1, 2 and 3 when they should be stationary.

More specifically, the control movement 15 comprises a first wheel 47 located under the day wheel 16, which is not visible in FIG. 8 but may be seen in FIGS. 9 and 10. This first wheel 47 is engaged with a gear 48, which in turn meshes with a second wheel 49 integral to the blocking movement 40. It is noted that the gear ratio is selected so that the blocking movement 40 advances one step per day like the control movement 15.

FIG. 8 shows that the block movement 40 comprises upper 41, intermediate 42 and lower 43 cylindrical sectors, which are arranged coaxially on one another and angularly offset in relation to one another. The flank 44 of the upper cylindrical sector 41 is arranged to selectively penetrate inside the trajectory formed by the tips of the teeth of the star wheel 14 provided for the lower disc 3. Similarly, flank 45 of the intermediate cylindrical sector 42 is arranged to selectively penetrate inside the trajectory formed by the tips of the teeth of the star wheel 13 provided for the intermediate disc 2. Finally, flank 46 of the lower cylindrical sector 43 is arranged to selectively penetrate inside the trajectory formed by the tips of the teeth of the star wheel 12 provided for the upper disc 1.

The movement from calendar day 20 to calendar day 21 will now be examined with reference to FIGS. 9 and 10, which show the positioning of the control movement 15, blocking movement 40 and cannon pinion star wheels 12, 13 and 14 for the two dates.

FIGS. 9*a*, 9*b* and 9*c* show the situation on the 20th of the current month. In FIG. 9*a*, the lower disc 3 connected to star wheel 14 has the numeral 31 aligned with the large aperture 20, numeral 31 is not visible because it is concealed by the intermediate disc 2. The cylindrical sector 41 of the blocking movement 40 is positioned so that star wheel 14 is immobilised (teeth 23 and 24). In FIG. 9*b*, the upper disc 1 connected to star wheel 12 has its window 5 (symbolised by the number 0 in the figure) aligned with the large aperture. The cylindrical sector 43 is positioned so that star wheel 12 is immobilised (teeth 3 and 4). In FIG. 9*c*, the intermediate disc 2 connected to star wheel 13 has the numeral 20 aligned with the large aperture 20 and this numeral 20 is visible through the window 5 of the upper disc 1. The cylindrical sector 42 is positioned so that star wheel 13 is free to move.

At midnight on the 20th of the month, the control movement 15 advances one step in the direction indicated by arrow A and the blocking movement 40 advances one step in the direction of arrow E being driven by? the gear 48. The star wheel 14 connected to the lower disc 3 and star wheel 13 connected to the intermediate disc 2 advance one step in the direction of arrow B. The star wheel 12 connected to the upper disc 1 is not driven by the movement 15, as the toothed sector 19 capable of causing this advancing movement is located diametrically opposed to star wheel 12.

FIGS. 10*a*, 10*b* and 10*c* show the situation on the 21st of the current month. In FIG. 10*a*, the lower disc 3 connected to the star wheel 14 has the numeral 21 aligned with the large aperture 20. Having turned in anticlockwise direction, the cylindrical sector 41 is disengaged from star wheel 13 and this enables it to follow its course to the 31st of the month. In FIG. 10*b*, the upper disc 1 connected to the star wheel 12, as previously, has its window 5 (symbolised by the number 0 in the figure) aligned with the large aperture. Star wheel 12 still remains blocked with flank 46 of the cylindrical sector 43 cutting the trajectory of teeth 3 and 4 of star wheel 12. In FIG. 10*c*, the intermediate disc 2 connected to the star wheel 13 has its window 7 (symbolised by the number 0 in the figure) aligned with the large aperture 20. Blocking of star wheel 13 by the cylindrical sector 42 starts by it turning in anticlockwise direction. Thus, on the 21st of the month the date is displayed by the lower disc 3 visible through windows 5 and 7 on discs 1 and 2 respectively.

What is claimed is:

1. A large date calendar day mechanism for a timepiece comprising indicators superposed one on top of the other, to which a portion of the numerals of the days of the month is affixed, said numerals appearing in turn through a large aperture drilled into the dial forming part of the timepiece, wherein the indicators comprise an upper disc, an intermediate disc and a lower disc, wherein the upper disc is divided into eleven sectors, of which ten are occupied by numerals from 1 to 10 and one is occupied by a window, through which the numerals of the intermediate disc can be seen, the intermediate disc is divided into eleven sectors, of which ten are occupied by numerals from 11 to 20 and one is occupied by a window, through which the numerals of the lower disc can be seen, and the lower disc is divided into eleven sectors, all of which are occupied by numerals from 21 to 31, in that each of the discs is driven by a cannon pinion integral to a star wheel, wherein these cannon pinions are freely pressed one into the other, and wherein a control movement fitted with a calendar day wheel advancing one step per day is arranged to selectively mesh with the star wheels provided for the discs in order to drive the upper disc while the other two discs remain stationary, to drive the intermediate disc when the upper disc has run through all its numerals while the upper and lower discs remain stationary, and to drive the lower disc when the intermediate disc has run through all its numerals while the upper and intermediate discs remain stationary.

2. The calendar day mechanism according to claim 1, wherein the control movement comprises upper, intermediate and lower toothed sectors, which are fixed coaxially on the calendar day wheel, arranged coaxially on one another and angularly offset in relation to one another, and which are arranged to selectively and respectively mesh with the star wheels provided for the lower, intermediate and upper discs.

3. The calendar day mechanism according to claim 2, wherein the upper, intermediate and lower toothed sectors each comprise eleven teeth, wherein the teeth of the lower sector are numbered from 1 to 11, those of the intermediate sector from 11 to 21 and those of the upper sector from 21 to 31, and in vertical projection these sectors form a wheel of thirty one teeth, wherein tooth 11 of the lower sector overlaps tooth 11 of the intermediate sector, so that window 5 of the upper disc and the calendar day numeral 11 positioned on the intermediate disc appear in the large aperture, wherein tooth 21 of the intermediate sector overlaps tooth 21 of the upper sector, so that window 7 of the intermediate disc and the calendar day numeral 21 positioned on the intermediate disc appear in the large aperture, and wherein tooth 31 of the upper sector adjoins tooth 1 of the lower sector, so that the calendar day numeral 1 positioned on the upper disc appears in the large aperture.

4. The calendar day mechanism according to claim 1, wherein the control movement drives a blocking movement, which is arranged to prevent any accidental advancing of the discs when they should be stationary.

5. The calendar day mechanism according to claim 4, wherein the control movement comprises a first wheel engaged with a gear, which in turn meshes with a second wheel integral to the blocking movement, the gear ratio being selected so that the blocking movement advances one step per day like the control movement.

6. The calendar day mechanism according to claim 4, wherein the block movement comprises upper, intermediate and lower cylindrical sectors, which are arranged coaxially on one another and angularly offset in relation to one another, the flanks of which are arranged to selectively and respectively penetrate inside the trajectories formed by the tips of the teeth of the star wheels respectively provided for the lower, intermediate and upper discs.

* * * * *